US006263518B1

(12) United States Patent
Magtanong

(10) Patent No.: US 6,263,518 B1
(45) Date of Patent: Jul. 24, 2001

(54) DRAIN STRAINER

(76) Inventor: Reynaldo B. Magtanong, 17925 Union Ave., Bellflower, CA (US) 90706

( * ) Notice: Subject to any disclaimer, the term of this patent is extended or adjusted under 35 U.S.C. 154(b) by 0 days.

(21) Appl. No.: 09/589,048

(22) Filed: Jun. 6, 2000

(51) Int. Cl.[7] ..... E03C 1/26
(52) U.S. Cl. ..... 4/289; 4/286; 4/290; 4/292
(58) Field of Search ..... 4/286, 287, 288, 4/289, 290, 291, 292, 293; 210/164, 165, 166, 460, 461

(56) References Cited

U.S. PATENT DOCUMENTS

| | | | | |
|---|---|---|---|---|
| 1,756,290 | * | 4/1930 | Hibner | 4/289 |
| 1,852,123 | * | 4/1932 | Lutsky . | |
| 1,925,008 | * | 8/1933 | Schacht . | |
| 2,279,683 | * | 4/1942 | Judell et al. . | |
| 2,337,331 | * | 12/1943 | Kirschner . | |
| 2,394,964 | * | 2/1946 | Dick . | |
| 4,232,407 | * | 11/1980 | Williams | 4/287 |

FOREIGN PATENT DOCUMENTS

| | | | | |
|---|---|---|---|---|
| 901754 | * | 8/1945 | (FR) | 4/287 |
| 289356 | * | 4/1928 | (GB) | 4/287 |
| 2103924 | * | 3/1983 | (GB) . | |
| 505892 | * | 12/1954 | (IT) | 4/287 |
| 98669 | * | 4/1940 | (SE) | 4/287 |

* cited by examiner

*Primary Examiner*—Timothy L. Maust
*Assistant Examiner*—Khoa Huynh
(74) *Attorney, Agent, or Firm*—Gene Scott - Patent Law & Venture Group

(57) ABSTRACT

An apparatus for straining fluid flow in a drainpipe, including a cylindrical body having a sidewall terminating with an integral closed end providing a means for engaging a drain plate, and, in opposition, an open end providing an integral uniform peripheral flange extending outwardly. The peripheral flange is adapted for a tight fitting relationship with a drain pipe inside surface; and, further, the side wall provided a plurality of apertures and a further plurality of surface protuberances extending outwardly from an exterior surface of the side wall.

7 Claims, 2 Drawing Sheets

DRAIN STRAINER

BACKGROUND OF THE INVENTION

1. Field of the Invention

This invention relates generally to strainers, and more particularly to an apparatus for straining out hair and small particles in a drain.

2. Description of Related Art

Drain coverings and strainers of various types are commonly used to keep items other than fluid from continuing through and blocking a drain. The biggest drain-clogging culprit is hair. Commonly used drain plates covering a drain opening do catch some hair, but the openings in them cannot be made fine enough to catch all the hair going through and yet also conduct high volumes of liquid quickly and effectively through the drain. Other drain coverings are in the form of pull caps with attached vertical portions extending down into the drain, designed to catch hair around the extension. However, only some of the hair passing next to the vertical downwards extension will catch on it. In contrast, the present invention utilizes a configuration of apertures and surface protuberances that both trap hair and small particles and guide water down through the apparatus body. The present invention provides further related advantages as described in the following summary.

SUMMARY OF THE INVENTION

The present invention teaches certain benefits in construction and use that give rise to the objectives described below.

The present invention is an apparatus for straining fluid flowing through a drain pipe, specifically designed to trap hair and small particles so that they do not clog plumbing pipes. The apparatus includes a cylindrical body which can be attached to a drain plate. On the opposite, downwardly-facing end of the body, an opening provides an outwardly-extending uniform peripheral flange. The peripheral flange fits tightly against a drain pipe inside surface. Extending outwardly from the apparatus cylindrical side wall are a number of holes and surface protuberances. The configuration of the holes and surface protuberances change the path of water flowing through the drain pipe from a downwards direction to a sideways direction, thereby trapping hair and small particles around the protuberances. The apparatus may be lifted out and cleaned frequently.

A primary objective of the present invention is to provide a drain strainer apparatus having advantages not taught by the prior art.

Another objective is to provide such an apparatus capable of redirecting the flow of fluid down a drain sideways through the apparatus instead of straight down into plumbing pipes.

A further objective is to provide such an apparatus with both apertures and surface protuberances capable of trapping to capture hairs and small particles, arranged in alternating fashion and extending outwardly from the apparatus body.

A further objective is to provide such an apparatus that is inexpensive to manufacture and economical in cost to consumers, as well as easy to install and clean.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
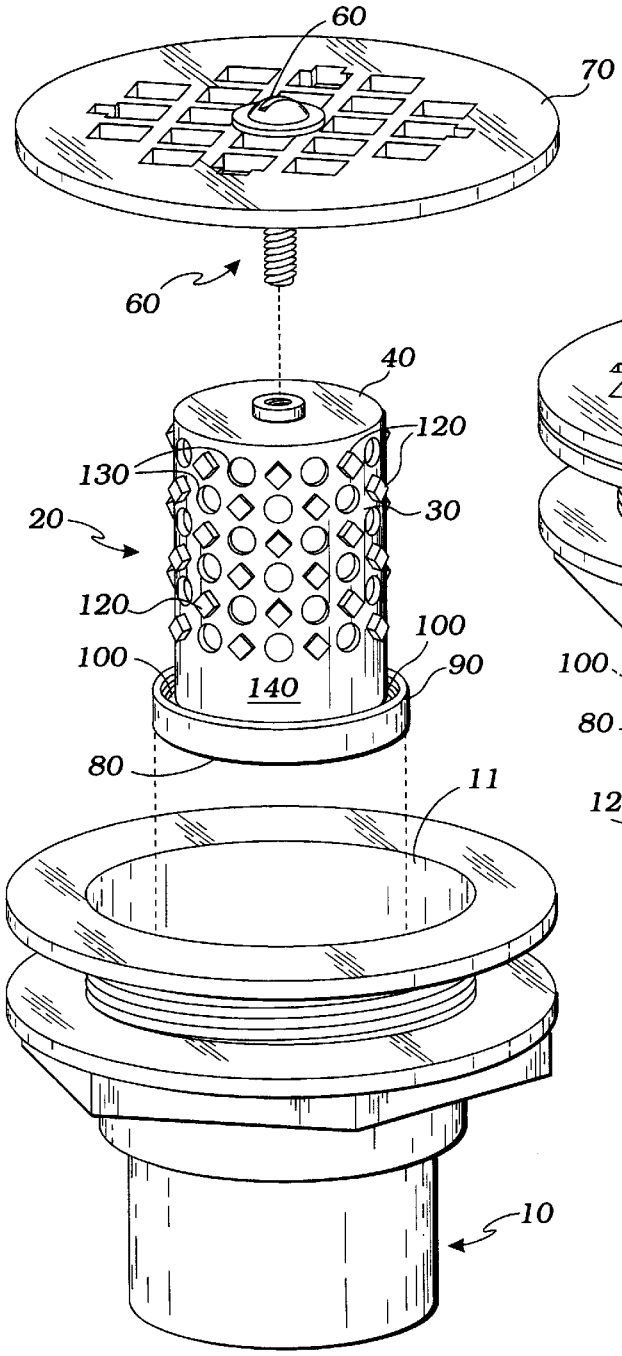
FIG. 1 is an exploded perspective view of the preferred embodiment of the apparatus.
Figure 2:
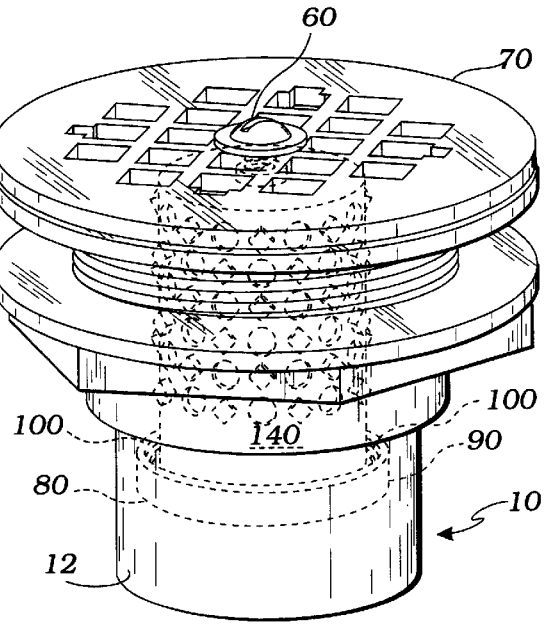
FIG. 2 is an interior perspective view thereof, shown assembled within a drain.
Figure 3:
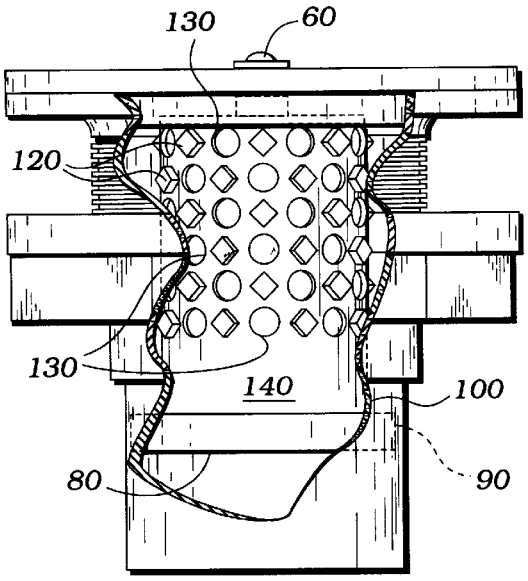
FIG. 3 shows the apparatus sidewall as viewed through a partially cut away drain pipe.

The above described drawing FIGS. 1–6 illustrate the invention, an apparatus for straining fluid flow in a drain pipe 10, the apparatus comprising: a cylindrical body 20 of a structural engineering material, preferably of an injection-molded plastic, having a side wall 30, and terminating with an integral closed end 40. The integral closed end 40 faces upwardly and is installed in a drain pipe upper opening 11, as shown in FIGS. 1, 4, 5, and 6. The integral closed end 40 is smaller in diameter than the drain pipe upper opening 11, to allow a fluid 50 to pass vertically down around it, but large enough in diameter relative to the drain pipe upper opening 11, so that fluid 50 cannot bypass the cylindrical body 20 entirely in its downwards path through the drain pipe 10, as shown in FIGS. 1, 4, 5, and 6.

The integral closed end 40 of the side wall 30 provides a drain plate engaging means 60 for engaging a drain plate 70. The drain plate 70 is one that is commonly known. Preferably, the drain plate engaging means 60 is a centrally positioned embossment extending away from an outer surface 41 of the integral closed end 40, the embossment providing a threaded hole therein, preferably a blind bore, for receiving an attachment hardware such as a screw, as is commonly known, for ease of removal by the average consumer, as shown in FIG. 1.

Figure 5:
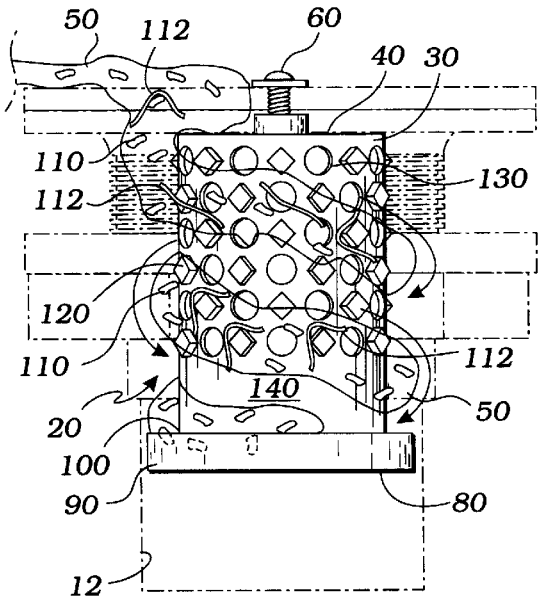
FIG. 5 is similar to FIG. 4, and shows the fluid channeled into a sideflowing direction, and hair and small particles trapped around surface protuberances thereon.
Figure 6:
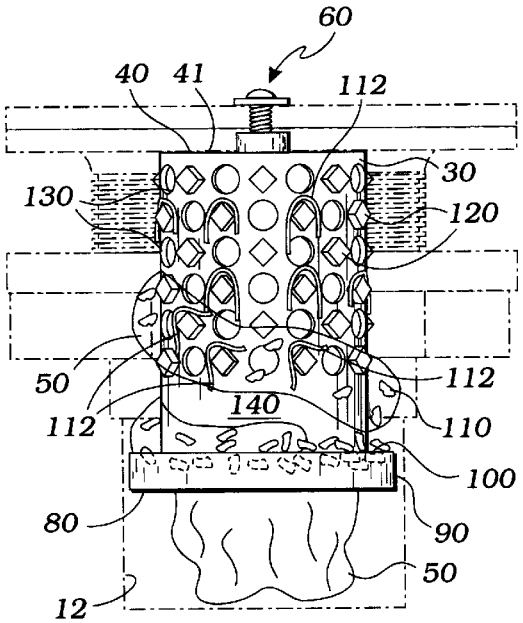
FIG. 6 is similar to FIG. 5, and shows fluid exiting down a drain pipe, with small particles trapped in an annular groove of a peripheral flange thereof.

In opposition to the integral closed end 40 of the cylindrical body 20 is a downwardly-facing cylindrical body open end 80. The open end 80 provides an integral uniform peripheral flange 90 extending outwardly therefrom. The peripheral flange 90 is adapted by its diameter for a tight fitting relationship with a drain pipe inside surface 12. Preferably, the peripheral flange 90 includes an annular groove 100 therein, the annular groove 100 forming a smooth transition with the side wall 30, as shown in FIGS. 1, 2, 5, and 6. The annular groove 100 is deep and wide enough to trap small particles 110, as shown in FIGS. 5 and 6.

The side wall 30 provides a plurality of apertures 130 therethrough, numerous and large enough to capture and direct portions of fluid 50 down and sideways through the cylindrical body 20 and down into the drain pipe 10. The side wall 30 provides a further plurality of surface protuberances 120, preferably rectangular, extending outwardly from an exterior surface 140 of the side wall 30. Preferably, the plurality of apertures 130 are arranged in alternating order with the plurality of surface protuberances 120 within longitudinally spaced-apart columns. Preferably, the longitudinally spaced-apart columns are arranged around the side wall 30. Preferably, the plurality of surface protuberances

Figure 4:
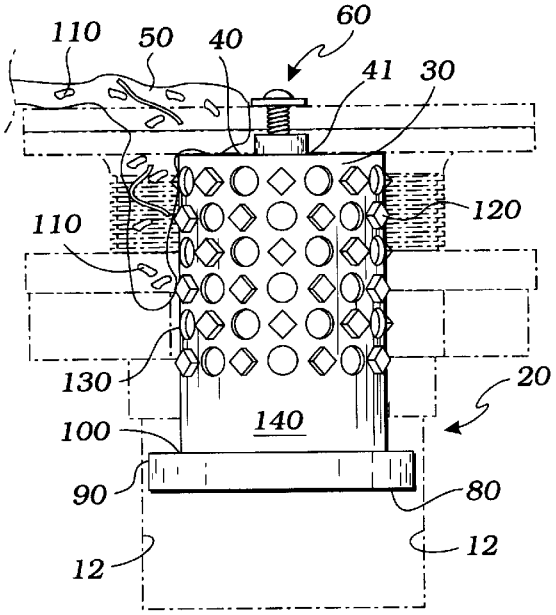
FIG. 4 shows fluid beginning to flow through a drain plate and down around the apparatus body.

120 are oriented on the side wall 30 so that their flat surfaces 122 are angled at a diagonal relative to the vertical, making it easier for fluid 50 to flow down between them and into the plurality of apertures 130, as shown in FIGS. 4, 5, and 6. The plurality of apertures 130 are also arranged in alternating order with the plurality of surface protuberances 120 within horizontal rows extending around the outside circumferential surface of side wall 30, as shown in FIGS. 1, 3, 4, 5, and 6.

Inventively, the apertures 130 create a suction effect when the fluid 50 enters the upper drain pipe 11, which pulls the fluid 50 sideways and down through the apparatus body 20. The alternating arrangement of apertures 130 and surface protuberances 120 create eddies which allow for further diversion of the downwardly flowing fluid 50 to a sideflowing direction. Inventively, the surfaces 122 of the surface protuberances 120, which slope downwardly at approximately a forty-five degree angle, help train and direct the flow of fluid 50 between the surface protuberances 120, where hair 112 and small particles 110 are caught on the surface protuberances 120, as shown in FIGS. 5 and 6. The small particles 110 then drop down and are caught by the annular groove 1 00.

A second embodiment of the apparatus is similar to the first, with the addition of the drain plate 70 for covering a drain pipe opening 160, such as is commonly known, the drain plate 70 providing a plurality of drain plate apertures 152 for admittance of a draining fluid 50 into the drain pipe 10.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for straining fluid flow in a drainpipe, the apparatus comprising:

a drain plate for covering an entrance to a drain pipe, the drain plate providing a plurality of drain plate openings for admittance of a draining fluid into the drain pipe;

a cylindrical body having a sidewall terminating with an integral closed end engaging the drain plate, and extending downwardly from the drain plate to establish an open end of the sidewall and an integral uniform peripheral flange extending outwardly from the sidewall, for tight fitting with the drain pipe inside surface, the side wall providing a plurality of apertures therethrough and a further plurality of surface protuberances extending outwardly from an exterior surface of the side wall, the cylindrical body positioned for receiving the draining fluid from the drainpipe, radially inwardly into the cylindrical body through the apertures.

2. The apparatus of claim 1 wherein the peripheral flange comprises an annular groove therein, the annular groove forming a smooth transition with the sidewall.

3. The apparatus of claim 1 wherein the drain plate engaging means is a centrally positioned embossment extending away from an outer surface of the closed end, the embossment providing a threaded hole therein for receiving an attachment hardware.

4. The apparatus of claim 1 wherein the plurality of apertures are arranged in alternating order with the plurality of surface protuberances within longitudinally spaced-apart columns.

5. The apparatus of claim 4 wherein the longitudinally spaced-apart columns are arranged around the sidewall.

6. The apparatus of claim 1 wherein the protuberances are rectangular.

7. The apparatus of claim 1 wherein the plurality of apertures arranged in alternating order with the plurality of surface protuberances within longitudinally spaced-apart columns, and the columns are arranged around the sidewall.

* * * * *